United States Patent [19]

Kawashima et al.

[11] Patent Number: 4,756,432

[45] Date of Patent: Jul. 12, 1988

[54] CRANE CONTROL METHOD

[75] Inventors: Haruhito Kawashima, Kawasaki; Seiji Yasunobu, Yokohama; Toshitsugu Hasegawa, Kudamatsu, all of Japan

[73] Assignee: Hitachi, Ltd., Tokyo, Japan

[21] Appl. No.: 71,389

[22] Filed: Jul. 9, 1987

[30] Foreign Application Priority Data

Jul. 11, 1986 [JP] Japan ..... 61-161835

[51] Int. Cl.[4] ..... B66C 19/00

[52] U.S. Cl. ..... 212/132; 212/147; 212/161

[58] Field of Search ..... 212/146, 147, 161, 132

[56] References Cited

U.S. PATENT DOCUMENTS

| | | | |
|---|---|---|---|
| 3,517,830 | 6/1970 | Virkkala | 212/146 |
| 3,921,818 | 11/1975 | Yamagishi | 212/161 |
| 4,512,711 | 4/1985 | Ling et al. | 212/147 |
| 4,603,783 | 8/1986 | Tax et al. | 212/147 |

FOREIGN PATENT DOCUMENTS 5895094 11/1981 Japan .

*Primary Examiner*—Joseph F. Peters, Jr.
*Assistant Examiner*—Stephen P. Avila
*Attorney, Agent, or Firm*—Fay, Sharpe, Beall, Fagan, Minnich & McKee

[57] ABSTRACT

A crane control method in which the parcels suspended from a rope is transversely carried by a trolley, the control being performed in an accelerating, a constant velocity travel, and a decelerating period separately, wherein the control is performed during said accelerating and decelerating only by turning on and off a predetermined accelerating and decelerating forces. More particularly, the control is performed by turning on and off the limit current value of the armature current through the motor. The present invention eliminates the necessity for feedback control by which a velocity pattern is followed.

5 Claims, 4 Drawing Sheets

CRANE CONTROL METHOD

BACKGROUND OF THE INVENTION (1) Field of the Invention

The present invention relates to a crane control method, and more particularly to a method of controlling a crane which makes it possible during transverse travel of the trolley to precisely transport parcels to the aimed location without substantial swing motions of the rope for suspending the parcels.

(2) Description of the Prior Art

To properly operate a crane, such as a container crane, in facilities in a port, for example, skill is required to exactly unload at the aimed point while restraining the suspended parcels from swinging.

Prior art methods of controlling a crane are known which make the crane travel, constraining the swing of the suspended parcels.

One of the prior art methods is the one in which the swing angle of the rope suspending the parcels is measured and feedback is applied so as to reduce the swing. This method, however, is not practical, since it is difficult to measure the swing angle.

A second prior art method is the one in which the velocity of the trolley is made to follow an objective velocity pattern calculated beforehand so as to restrain the swing of the suspended parcels, as described in Laid-open Japanese Patent Application No. 95094/83 or in U.S. Pat. No. 3,921,818. According to this method, the tractive force must have a margin so as to be able to correct the difference between the actual and objective speeds of the trolley due to external disturbances, such as wind. Furthermore, it is impossible to utilize the capability of the driving motor to the maximum extent in order to make the trolley travel to the optimum point in the minimal time and, as a result, there is a problem in that the cycle time is rather long.

SUMMARY OF THE INVENTION

It is, therefore, a principal object of the present invention to realize a crane control method which makes it possible to easily transport suspended parcels with little swing.

Another object of the present invention is to realize a crane control method which makes it possible to easily transport suspended parcels with little swing and to easily and rapidly unload at an objective point with little swing.

A further object of the present invention is to realize a method reducing the swing of suspended parcels by the on/off control of objective accelerating and decelerating forces.

In order to achieve the above objects, in a crane control method according to the present invention, in which a trolley is made to travel at a objective velocity depending on the position of the trolley, the length of the rope suspended from the trolley, and the weight of the load: an accelerating period, in which the trolley is accelerated, comprises two subperiods spaced by an intermediate pause period, satisfying two requirements, firstly that there remain no rope swing after the acceleration of the trolley, and secondly that the speed is an objective value after the acceleration; the acceleration is done with a known constant force which is turned on and off such that it is applied in the two subperiods and not in the pause period. On the other hand, a decelerating period, in which the trolley is decelerated, comprises two subperiods spaced by an intermediate pause period, satisfying two requirements, firstly that there remain no swing after the deceleration, and secondly that it can stop at an aimed position after it has been decelerated from a objective velocity; the deceleration is done with a known constant force which is turned on and off such that it is applied in the two subperiods and not in the intermediate pause subperiod.

According to the method of the present invention, the ON/OFF period of a known constant trolley accelerating force is determined depending on the measured data of the trolley position, rope length and weight of the load, and the known values of the weight of the trolley, maximum accelerating force and running resistance, and the swing can be restrained only by the ON/-OFF control without following a speed pattern.

The above-mentioned and other features and objects of this invention will become more apparent by reference to the following description taken in conjunction with the accompanying drawings.

DETAILED DESCRIPTION OF EMBODIMENTS

Figure 1:
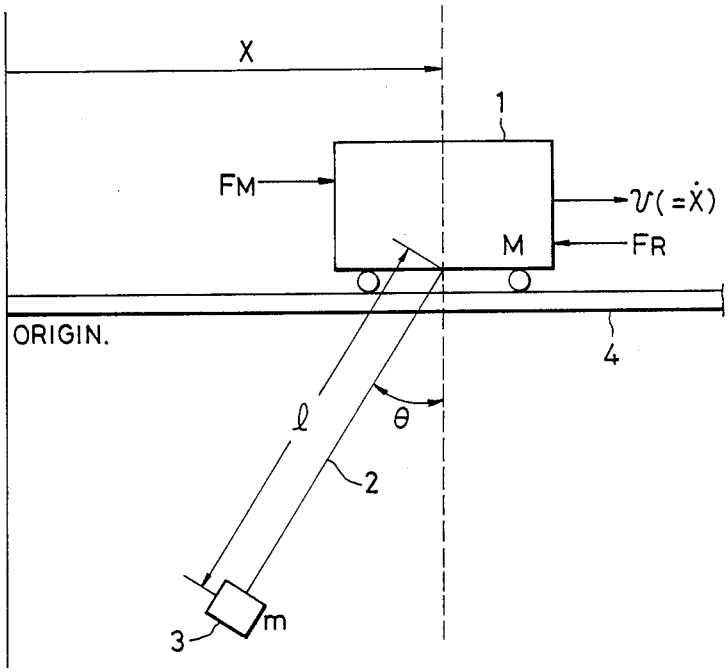
FIG. 1 is a diagram for explaining the principle of the crane control.

FIG. 1 shows a dynamic model of a crane for explaining the principle of the present invention. In this figure, M represents the mass of a trolley 1, m the mass of a suspended parcel 3, l the length of a rope 2, $\theta$ the swing angle of the rope, $F_M$ the accelerating force, v the transverse velocity of the trolley, and $F_R$ the traveling resistance. 4 represents rails.

According to the method of controlling the speed of the trolley using the motor, an objective speed being given, an accelerating force corresponding to the maximum armature current (called "limit current" hereinafter) is applied for acceleration and, after the objective velocity has been reached, that speed is maintained.

The running resistance force $F_R$ to the trolley is represented by $(m+M).R(X_A)$, where $F_M$ represents the magnitude of the constant maximum accelerating force which corresponds to the motor limit current (maximum accelerating force), R(X) represents the running resistance to the trolley given in the form of a function of the position x of the trolley with respect to the origin, $X_A$ represents the position at which acceleration takes place. Here, the actual accelerating force $F_O$ is $F_M - F_R$.

FIGS. 2A, 2B, 2C, 2D and 2E show the change in time of the actual accelerating and decelerating forces $F_O$, objective velocity of the trolley, ON/OFF command signals for the armature current through the motor for driving the trolley, armature current, and trolley speed, respectively, in the crane control method according to the present invention.

Figure 2A:
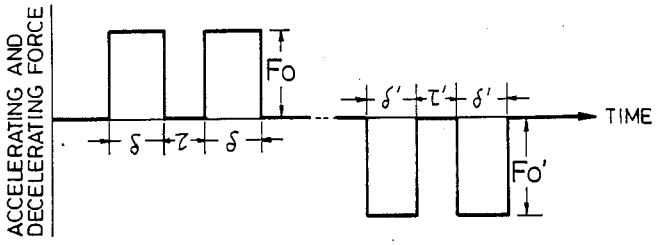
FIGS. 2A, 2B, 2C, 2D and 2E are diagrams showing accelerating and decelerating force, objective velocity of trolley, armature current OFF command, armature current and velocity of trolley.
Figure 2B:
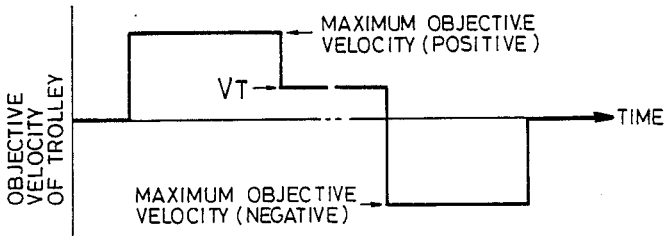
Figure 2C:
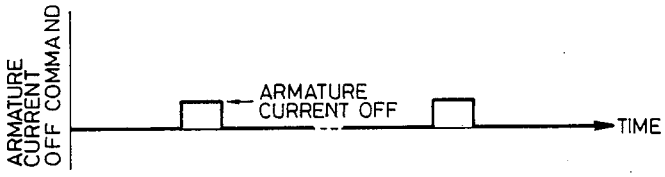
Figure 2D:
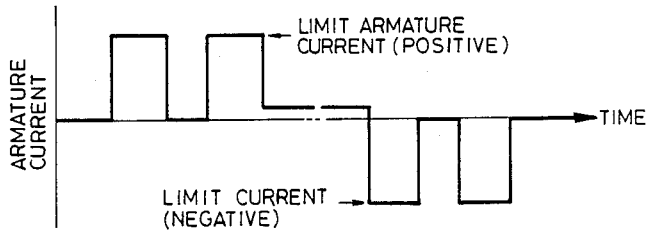
Figure 2E:
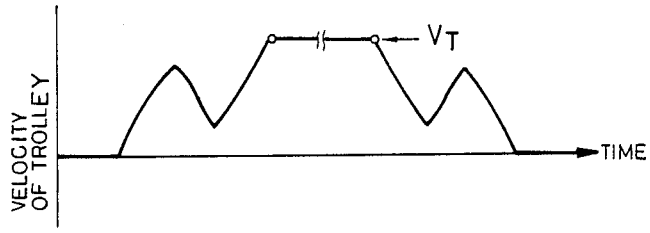

According to the present invention, a force $F_O$ is applied for acceleration for two subperiods $\delta$ separated by a pause subperiod $\tau$ during an accelerating period, as shown in FIG. 2A. During the accelerating subperiod by the accelerating force $F_O$ a command for the maximum objective velocity is given to the motor control device (FIG. 2B), while during the pause subperiod the motor armature current is turned off (FIG. 2C) to perform the above described control. During the pause subperiod, the objective velocity to be given to the motor control may continue to be the maximum velocity (FIG. 2B).

After these two subperiod accelerations, the trolley will reach an objective velocity $V_T$ at which the trolley will constantly travel.

The accelerating subperiod $\delta$ and pause subperiod $\tau$ are set in the following manner in order to satisfy two requirements, i.e., firstly that the objective velocity $V_T$ be reached after the acceleration, and secondly that there remain no swing of the suspended parcel.

Now assuming that the rope length is l, the gravitation acceleration is g, and the trolley actual acceleration force is $F_O=F_M-F_R$, then the swing angle $\theta$ of the rope will change during acceleration at an angular velocity:

$$\omega=\sqrt{(m+M)g/Ml}. \quad (1)$$

Here, the requirement for restraining the swing is:

$$\tan(\omega\tau/2)\cdot\frac{F_O\sin\omega\delta}{F_O+F_R-F_O\cos\omega\delta}=1. \quad (2)$$

Next, the following equation can be obtained as the requirement for making the trolley reach the objective velocity from the condition that the amount of work done by the accelerating force equals the kinetic energy after the acceleration:

$$\tfrac{1}{2}(m+M)V_T^2=\frac{(2F_o\delta-F_R\tau)^2}{2(m+M)}+\frac{\alpha^2}{mgl}[F_o^2+(F_o+F_R)^2-2F_o(F_o+F_R)\cos\omega\delta-(F_o+F_R)^2\cos\omega\tau+2F_o(F_o+F_R)\cos(\omega(\delta+\tau))-F_o^2\cos(\omega(2\delta+\tau))] \quad (3)$$

$$\text{where } \alpha=-\frac{ml}{m+M} \quad (4)$$

The $\delta$ given by the above (2) and (3) corresponds to the accelerating subperiod to elapse two times, and $\tau$ corresponds to the pause period.

After the acceleration period $2\delta+\tau$, the trolley travels at a constant objective velocity $V_T$.

The stop position to be reached by the trolley after deceleration is determined during the constant velocity travel, and the deceleration is commenced at a determined time point.

The stop position to be reached after the deceleration may be obtained, for example, in the following manner. The velocity during the constant velocity travel being $V_T$ and the time required for the deceleration $2\delta'+\tau'$, the mean acceleration during the deceleration is:

$$a=-V_T/(2\delta'+\tau') \quad (5)$$

Assuming that the kinetic energy in the constant velocity travel has been expended during the deceleration, the following equation holds good:

$$(m+M)aX_D=\tfrac{1}{2}(m+M)V_T^2 \quad (6)$$

where $X_D$ is the distance traveled from the beginning of the deceleration to the stop. Therefore, $X_D$ can be obtained from the equations (5) and (6), from which $X_D$ and the present position X it is possible to determine the position where the trolley is to stop.

Figure 3:
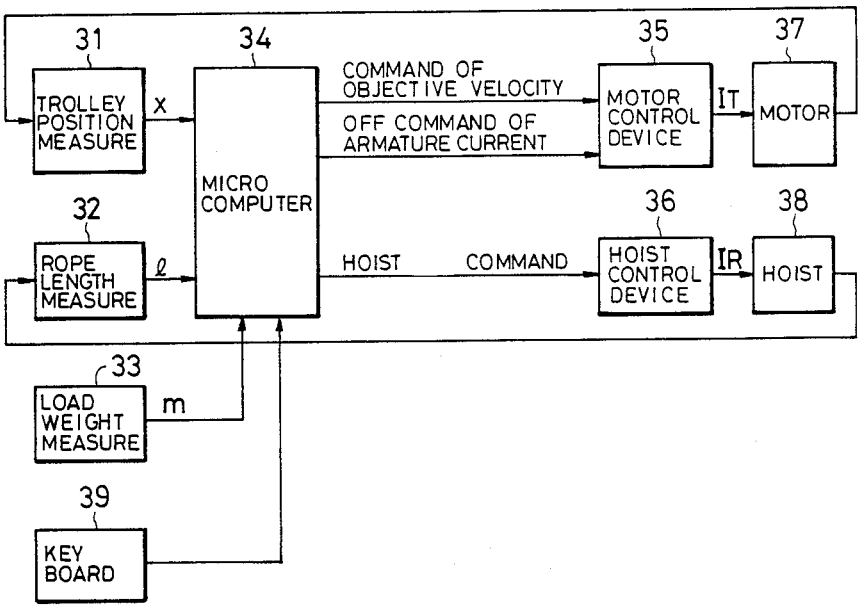
FIG. 3 is a block diagram of a crane control apparatus for implementing the invention.

FIG. 3 is a block diagram of a crane control device for implementing the present invention. In this figure, 31 represents a device for measuring the present position of the trolley 1; 32 represents a device for measuring the length l of the rope 2; 33 represents a device for measuring the weight m of the suspended parcel; 34 represents a microcomputer which receives the measurement from each of the above measuring devices so as to output control signals including a command for the objective velocity $V_T$, another command of ON/-OFF for the armature current in the trolley driving motor, and a command for winding the rope; 35 represents a motor control device which receives the trolley objective velocity command ($V_T$) and the armature current ON/OFF command signal so as to control the motor; 36 represents a rope driving and controlling unit for making a hoist 38 carry and raise and lower the suspended parcels. 39 represents a keyboard for supplying various parameters and control commands to the microcomputer 34.

Figure 4:
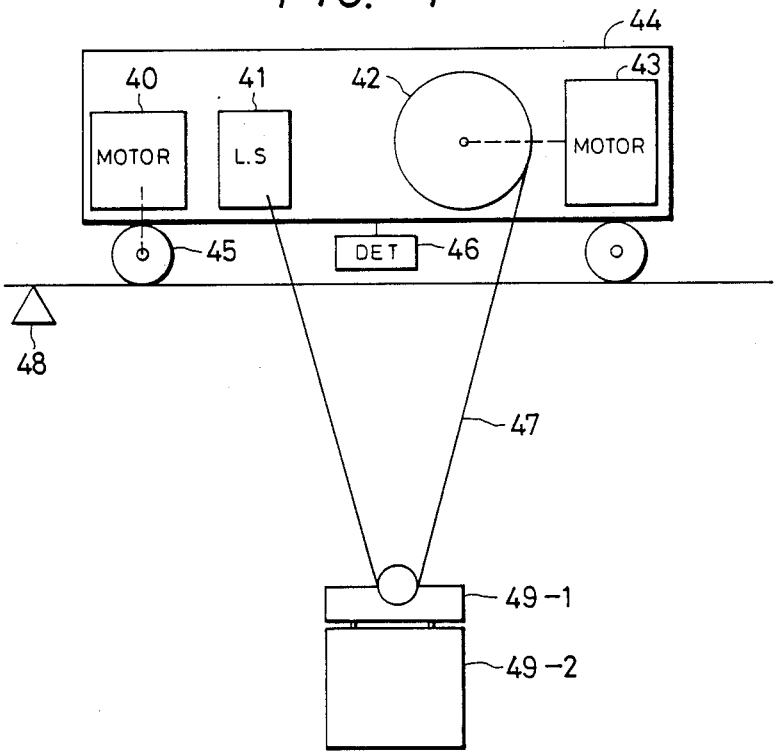
FIG. 4 is a diagram showing a constitution of a trolley.

FIG. 4 shows a trolley 44 which is the main element of the crane. The trolley 44 has mounted thereon the motor 40 which comprises the trolley drive control unit 35, the hoist for winding up the rope 47, a motor 43 for driving a reel for the rope 47 of the hoist, a load cell 41 for detecting the load m from the tension of the rope, and a mark detector 46 for detecting position marks 48 on the rails. The load m is the sum of the weight of a parcel 49-2 such as a container and the weight of a spreader 49-1 for holding the parcel.

The above mentioned trolley position measuring device is adapted to count pulses generated by a tachometer (not shown) which is interlocked with wheels 45 driven by the motor 40, and derives the present position X(t) from the distance traveled by the trolley from the original point mark detected by the detector 46. Similarly, the rope length measuring device 32 also counts output pulses from another tachometer (not shown) which is interlocked with the hoist for rotation, in order to derive the present rope length l(t).

Figure 5:
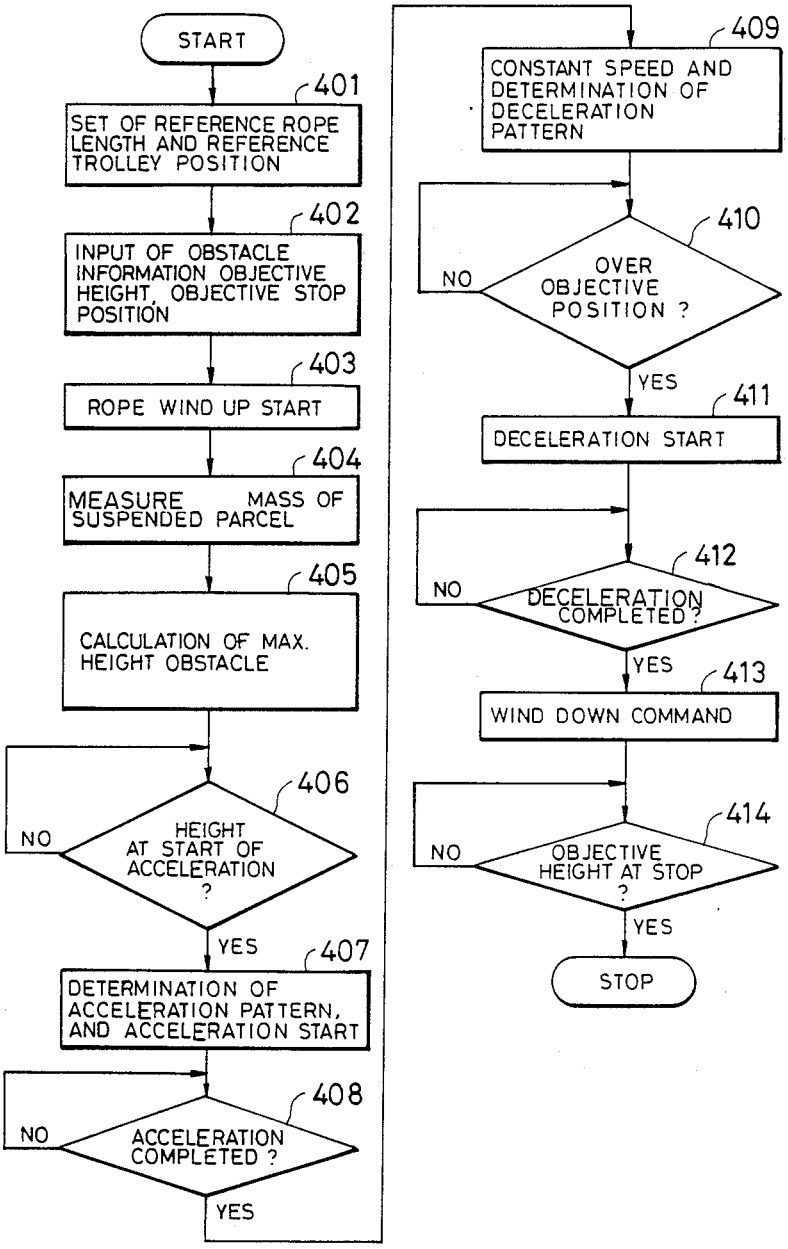
FIG. 5 is a flow chart of a control for executing a crane control according to our invention.

An embodiment of the crane control method according to the present invention will now be described with reference to a flowchart shown in FIG. 5.

First, at step 401, the reference rope length is set and input into the microcomputer by means of the keyboard 39 before depression of a start button.

After the microcomputer has started to operate, the rope length l(t) and the trolley position X(t) are measured at a constant time interval by means of the rope length measuring device 32, the trolley position measuring device 31 and the device described above with reference to FIG. 4, and the measurements are input into the microcomputer 34.

Next, at step 402, the objective rope length as well as objective trolley position at the position to which the suspended parcel is to be carried, and information regarding obstacles which may be present on the path along which the trolley is to move, are input from the keyboard 39.

At step 403, the operation to wind up the rope is initiated. At step 404, the weight of the load is measured during winding up of the rope by means of the load weight measuring device 33 of FIG. 3. The load weight is measured by the method described with reference to FIG. 4, or is derived from the winding-up speed and the current through the electric motor at that time.

At step 405, the maximum height over which the load must pass is calculated from the obstacle information input at step 402.

At step 406, it is determined whether the height of the load suspended from the wound up rope has become the maximum height obtained by the step 405 plus 1.0 m (lateral acceleration initiation height).

At step 407, acceleration is initiated after the load acceleration initiating height has been reached.

In the velocity control method using the motor, an objective velocity is given, acceleration is made with an accelerating force which corresponds to the maximum armature current (called "limit current"), and the objective velocity, after having been reached, is maintained constantly.

As explained with reference to FIG. 2, an acceleration by a substantially constant force $F_O$ of a subperiod $\delta$ is done two times, with an acceleration pause subperiod $\tau$ being provided between the two acceleration subperiods. During the subperiods of acceleration by the substantially constant force $F_O$, the electric motor control device 35 is directed to provide, for example, the possible maximum objective velocity, while during the pause subperiod the armature current is turned OFF in accordance with the above described control method. On the other hand, during the pause period $\tau$, the command to be given to the electric motor control 35 may be maintained at the maximum objective velocity. The trolley will reach the objective constant velocity $V_T$ after the two accelerations. The accelerating subperiod $\delta$ and the pause subperiod $\tau$ are determined by the above described equations (2) and (3). That is, since the parameters, for example, m, M, g, l, $F_O$, and $F_R$, required to derive the $\delta$ and $\tau$ of the equations (2) and (3) have already been given either as a constant or as a measurement, these are calculated by the microcomputer using these parameters.

At step 408, it is judged whether the $2\delta+\tau$ acceleration period has ended, and if it has ended, then a constant velocity travel is made at step 409 with the objective velocity $V_T$ being maintained. During the constant velocity travel period, with the resistance force $F_R$ arising from the running resistance in the equation (3) taken as the one in the decelerating period, two decelerating subperiods $\delta'$ and an intermediate pause subperiod $\tau'$ are determined as shown in FIG. 2, similarly to the case of the acceleration. Further, during the constant velocity travel, at step 410, the stop position for the trolley after the deceleration is repeatedly determined at a constant interval (for example, 10 msec) and the deceleration of step 411 is initiated when the determined stop position is judged to be beyond the objective stop position.

The deceleration of step 411 is performed with the negative maximum objective velocity, negative limit armature current and by turning off of the armature current, contrary to the case of the acceleration. At step 412 it is judged whether the said decelerating period of $2\delta'+\tau'$ has ended or not, and, if it has ended, then 0 is given as an objective velocity to the electric motor control device 35.

After the trolley has stopped, unwinding of the rope is initiated to lower it at step 413, and thereafter the unwinding is stopped when the objective stop height is reached.

As described above by reference to the exbodiment, the present invention makes it possible to restrain the suspended parcels from swinging by turning on and off a known constant accelerating or decelerating force, without requiring any velocity pattern to be followed.

We claim:

1. A crane control method of transversely carrying a parcel suspended from a rope by means of a trolley, said method comprising:

measuring the weight of the trolley, the weight of the suspended parcels, and the length of the rope for the suspended parcels;

determining the length of first and second accelerating subperiods and of an acceleration pause period from said weight of the suspended parcels, said weight of said trolley, said rope length and known characteristics of said trolley;

accelerating the trolley from its stationary state to an objective velocity, during said first accelerating subperiod during which a known constant force is applied for the accelration, said acceleration pause period following said first accelerating subperiod, and said second accelerating subperiod following said pause period, during which the same acclerating force is applied for the same time period as said first accelerating subperiod;

making said trolley travel at said objective velocity; and decelerating said trolley from said objective velocity to stop at an objective position, during a first decelerating subperiod during which a known constant force is applied for the deceleration, and a deceleration pause period following said first decelerating subperiod, and a second decelerating subperiod following the pause period, during which the same decelerating force is applied for the same time period as said first decelerating subperiod.

2. The crane control method according to claim 1, wherein said known constant force in said accelerating step is the maximum accelerating force minus the running resistance force, and wherein said known constant force in said declerating step is the maximum decelerating force of said trolley plus the running resistance force.

3. The crane control method according to claim 2, wherein the known constant accelerating step or declerating step force, respectively, is obtained by turning on and off the limit armature current through the DC motor for driving the trolley.

4. A crane control for transversely carrying a parcel suspended from a rope by means of a trolley, comprising:

means for measuring the weight of the trolley, the weight of the suspended parcels, and the length of the rope for the suspended parcels;

means for determining the length of first and second accelerating subperiods and of an acceleration pause period from said weight of the suspended parcels, said weight of said trolley, said rope length and known characteristics of said trolley;

means for accelerating the trolley from its stationary state to an objective velocity, during said first accelerating subperiod during which a known constant force is applied for the accelration, said acceleration pause period following said first accelerating subperiod, and said second accelerating subperiod following said pause period, during which the same acclerating force is applied for the same time period as said first accelerating subperiod;

means for making said trolley travel at said objective velocity; and means for decelerating said trolley from said objective velocity to stop at an objective position, during a first decelerating subperiod during which a known constant force is applied for the deceleration, and a deceleration pause period following said first decelerating subperiod, and a second decelerating subperiod following the pause period, during which the same decelerating force is applied for the same time period as said first decelerating subperiod.

5. The crane control according to claim 4, further including motor means for driving said trolley; and means for turning on and off current through said motor means for driving the trolley to respectively provide said known constant force applied by said means for accelerating and said known constant force supplied by said means for decelerating.

* * * * *